US009849681B2

(12) United States Patent
Campbell-Brown et al.

(10) Patent No.: US 9,849,681 B2
(45) Date of Patent: Dec. 26, 2017

(54) STRUCTURE FOR PRINTHEAD HAVING MULTIPLE AIR CHANNELS

(71) Applicant: Hewlett-Packard Development Company, L.P., Houston, TX (US)

(72) Inventors: Iain Campbell-Brown, Leixlip (IE); Eugene Cahill, Leixlip (IE); Ivor Cummins, Leixlip (IE); William Jon Rittgers, Leixlip (IE)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/039,571

(22) PCT Filed: Nov. 27, 2013

(86) PCT No.: PCT/US2013/072246
§ 371 (c)(1),
(2) Date: May 26, 2016

(87) PCT Pub. No.: WO2015/080728
PCT Pub. Date: Jun. 4, 2015

(65) Prior Publication Data

US 2017/0173949 A1 Jun. 22, 2017

(51) Int. Cl.
*B41J 2/175* (2006.01)
*B41J 2/14* (2006.01)

(52) U.S. Cl.
CPC ..... *B41J 2/175* (2013.01); *B41J 2/1752* (2013.01); *B41J 2/17509* (2013.01); *B41J 2/17523* (2013.01); *B41J 2002/14419* (2013.01)

(58) Field of Classification Search
CPC ..... B41J 2/175; B41J 2/17523; B41J 2/1752; B41J 2/17509; B41J 2002/14419
See application file for complete search history.

(56) References Cited

U.S. PATENT DOCUMENTS

| | | | | |
|---|---|---|---|---|
| 5,121,130 | A | 6/1992 | Hempel et al. | |
| 5,459,501 | A | 10/1995 | Lee et al. | |
| 6,457,819 | B2 | 10/2002 | Santhanam | |
| 7,682,008 | B2 | 3/2010 | Platt et al. | |
| 7,918,533 | B2 | 4/2011 | Silverbrook et al. | |
| 8,684,505 | B2 * | 4/2014 | Campbell-Brown | B41J 2/19 347/49 |
| 2005/0195251 | A1 * | 9/2005 | Nishida | B41J 2/17513 347/84 |
| 2006/0050098 | A1 | 3/2006 | Kim | |
| 2007/0046739 | A1 | 3/2007 | Lee et al. | |

(Continued)

FOREIGN PATENT DOCUMENTS

WO 2013141836 9/2013

OTHER PUBLICATIONS

International Searching Authority, "Search Report", issued in connection with PCT patent application No. PCT/US2013/072246, dated Aug. 26, 2014, 10 pages.

(Continued)

*Primary Examiner* — Geoffrey Mruk
(74) *Attorney, Agent, or Firm* — HP Inc. Patent Department

(57) ABSTRACT

A structure comprises inlets through which respective liquids are to be introduced and multiple unique vent paths each corresponding to one of the inlets.

19 Claims, 12 Drawing Sheets

(56) References Cited

U.S. PATENT DOCUMENTS

| | | | |
|---|---|---|---|
| 2008/0024567 | A1 | 1/2008 | Silverbrook |
| 2008/0284818 | A1 | 11/2008 | Anagnostopoulos |
| 2009/0079789 | A1 | 3/2009 | Silverbrook |

OTHER PUBLICATIONS

International Searching Authority, "Written Opinion", issued in connection with PCT patent application No. PCT/US2013/072246, dated Aug. 26, 2014, 7 pages.

* cited by examiner

STRUCTURE FOR PRINTHEAD HAVING MULTIPLE AIR CHANNELS

BACKGROUND

In certain liquid dispensers, printheads are part of a discrete assembly separate from detachable containers, in which a liquid is held in a block of foam or other capillary material inside the container. Known examples of such dispensers and detachable containers are printers and ink containers, respectively. The liquid holding chamber in these foam based containers is vented to the atmosphere through a hole in the top of the container. The container vent hole is sealed during storage and shipment to prevent evaporation from the ink chamber. The container vent is sometimes not functional when the container is installed in a printhead assembly, for example when the user fails to sufficiently remove the vent seal. The printer will not print properly with a malfunctioning container vent.

DRAWINGS

The same part numbers designate the same or similar parts throughout the figures.

DESCRIPTION

A vent through a structure of a printhead assembly has been developed as an addition or alternative to the conventional vent on a detachable ink container. The new vent allows the container to supply ink to the printhead assembly even if the vent on the ink container malfunctions, for example if the user fails to remove the tape sealing the vent or if there is a defect in the vent that prevents air from reaching the ink chamber inside the container. In one example of the new vent, an air hole is formed through a substrate of a printhead support structure near the ink inlet so that the container ink outlet is exposed to the air hole when the container outlet is engaged with the ink inlet of the printhead support structure, that is, when the ink container is installed on the structure. Separate, unique air channels on the back side of the substrate connect each of the air holes to the atmosphere, thus venting the ink container to the atmosphere through the printhead support structure when the container is installed in the support structure. Each unique air channel is associated with a different liquid inlet to prevent that different liquids of ink could mix near the ink inlet.

Examples of the structure are described with reference to ink containers for an inkjet printer but are not limited to ink containers or inkjet printers. Examples of the structure might also be implemented in other types of liquid dispensers, such as pharmaceutical liquid dispensers, digital titration devices, laboratory equipment or three dimensional printing devices. For example, besides ink, liquids other than ink can be used such as pharmaceutical liquids, chemical agents, etc.

As used in this document, "liquid" means a fluid not composed primarily of a gas or gases; and a "printhead" means that part of a printer or other type dispenser that dispenses liquid from at least one nozzle, for example as drops or streams. In an example a printhead may contain multiple nozzle arrays wherein each nozzle array may dispense at least one color ink. For example one printhead includes at least one nozzle array to dispense black and another printhead includes multiple nozzle arrays to dispense Cyan, Magenta and Yellow. In this disclosure a printhead assembly means that part of the printer that includes at least one printhead. The printhead assembly is part of the overall support structure. Although the figures illustrate a scanning type support structure, the invention can also apply to a fixed array printhead assemblies. Where appropriate, a printhead assembly may be abbreviated by PHA in the description and figures.

Figure 1:
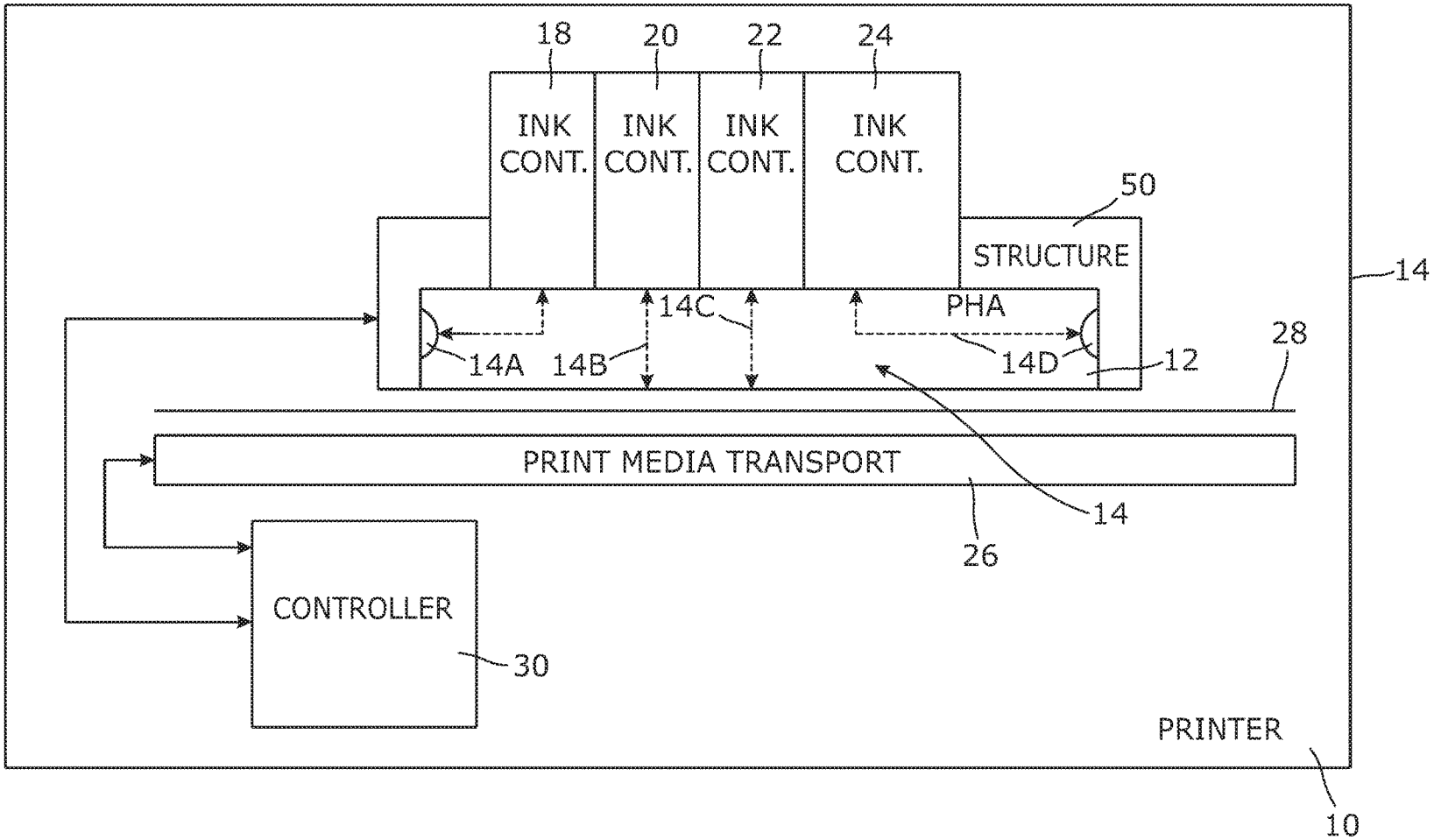
FIG. 1 is a block diagram illustrating an example inkjet printer.

FIG. 1 is a block diagram illustrating an inkjet printer 10 with a printhead assembly carrying structure 50 implementing one example of new container vents 14. FIGS. 2-9 illustrate in detail one example of a printhead assembly structure 50 with such vents 14 such as might be used in the printer shown in FIG. 1. Referring first to FIG. 1, a printer 10 includes a structure 50 carrying a printhead assembly (PHA) 12 and detachable ink containers 18, 20, 22, and 24 that supply ink to the printhead assembly 12. An interior, ink holding chamber of each container 18-24 is vented to the atmosphere through unique vents 14 in the printhead assembly 12. In the example shown in FIG. 1, container vent 14 includes four separate vents 14A, 14B, 14C and 14D that separately vent each of the ink containers 18, 20 and 22, 24, respectively.

The printhead assembly 12 includes at least one printhead 46, 48 through which ink from the multiple containers 18-24 is to be ejected. A print media transport mechanism 26 is to advance a sheet of paper or other print media 28 past structure 50 and printhead assembly 12. A controller 30 is operatively connected to printhead assembly 12 and media transport 26. Here, the controller 30 represents generally a processor and associated memory, instructions stored on the memory, and the electronic circuitry and other components needed to control the operative elements of printer 10.

Figure 2:
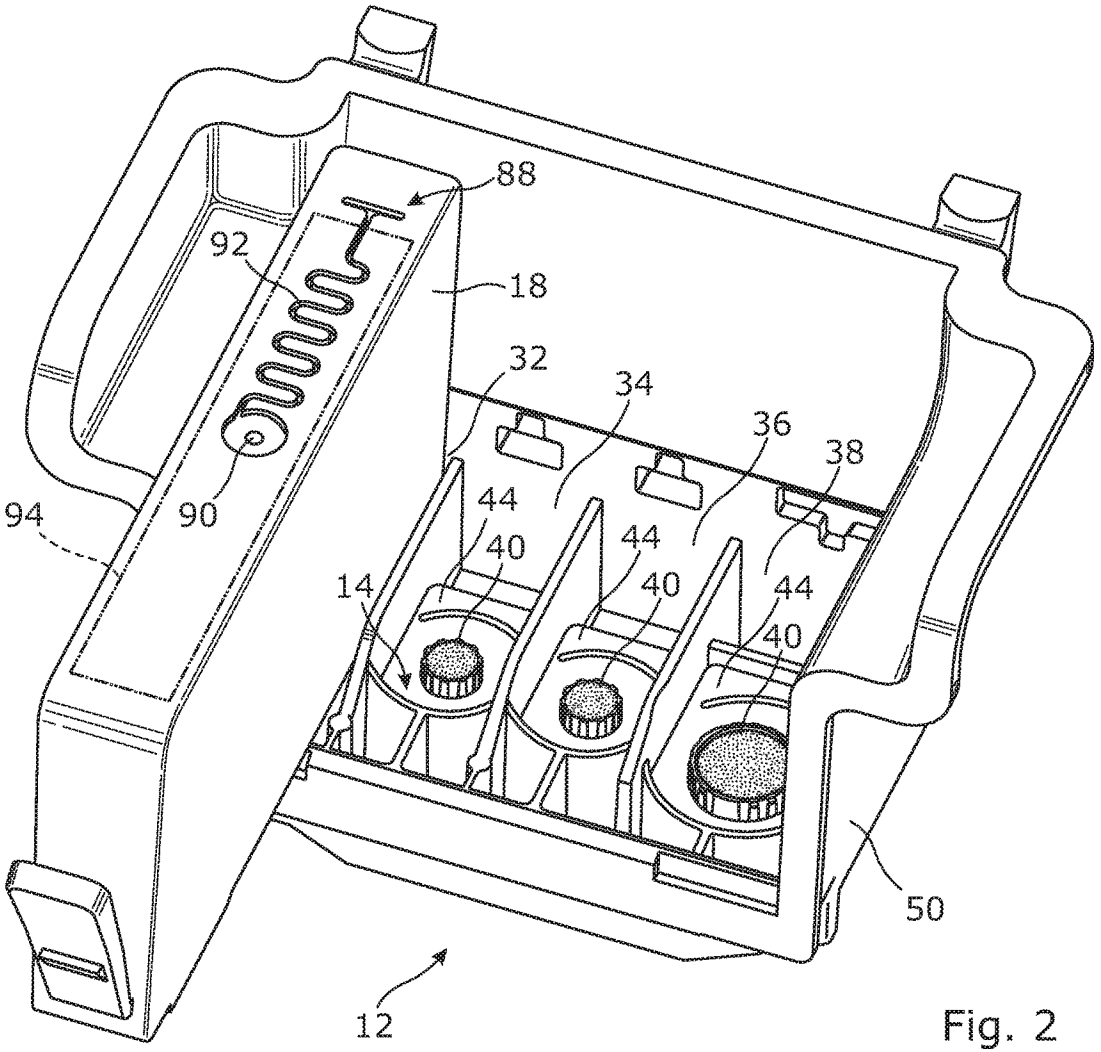
FIGS. 2 and 3 are perspective views illustrating an example structure with an ink container in connected state.
Figure 3:
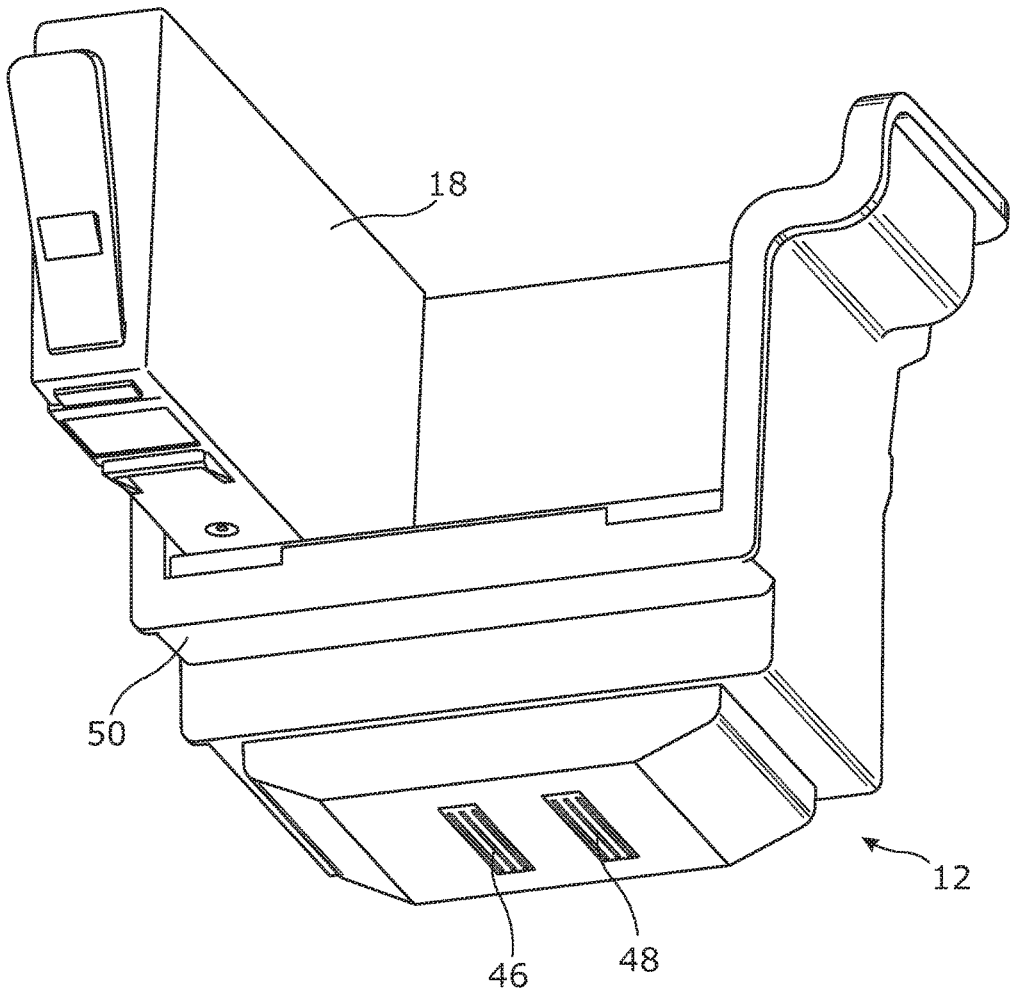

Referring now to FIGS. 2 and 3, the structure 50 includes bays 32, 34, 36, and 38 for receiving detachable ink containers 18-24, respectively, for example each of a different ink type such as black, cyan, magenta and yellow. Only one ink container 18 is shown installed in the structure 50 in FIGS. 2 and 3 to better illustrate some of the features of the structure 50. The structure 50 includes ink inlets 40 for receiving ink from a corresponding ink outlet 42 on each detachable ink container 18-24. Each ink inlet 40 is configured as a tower that is surrounded by an annular seal 44 that seals against the bottom of each container outlet 42 when the container is installed in the structure 50. In the example shown, the printhead assembly 12 includes two printheads 46 and 48. For example, ink from color ink containers 18-22 is ejected from a first printhead 46 and ink from a black ink container 24 is ejected from a second printhead 48.

Figure 4:
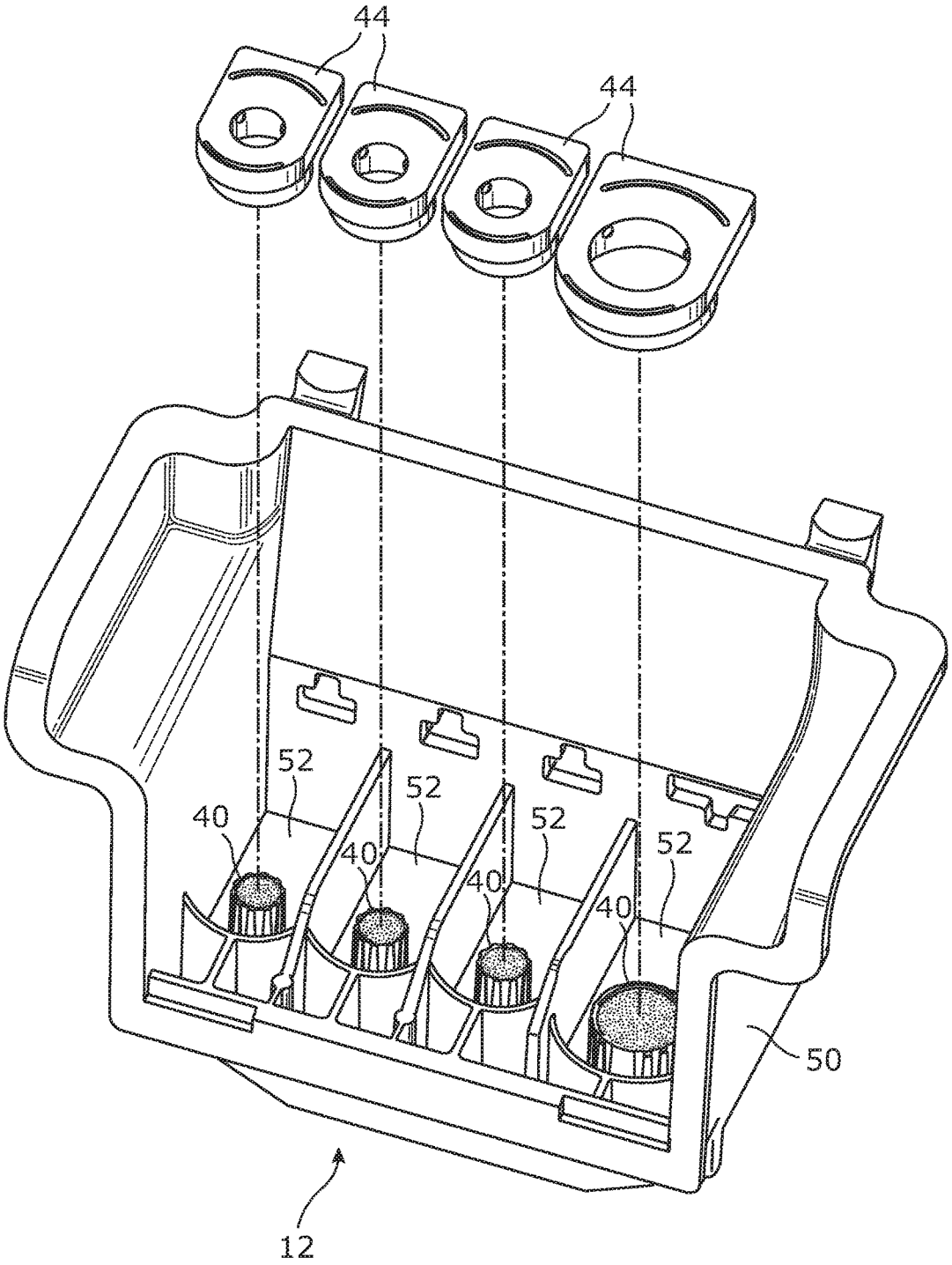
FIG. 4 is an exploded top side perspective view of the example structure of FIGS. 2 and 3.
Figure 5:
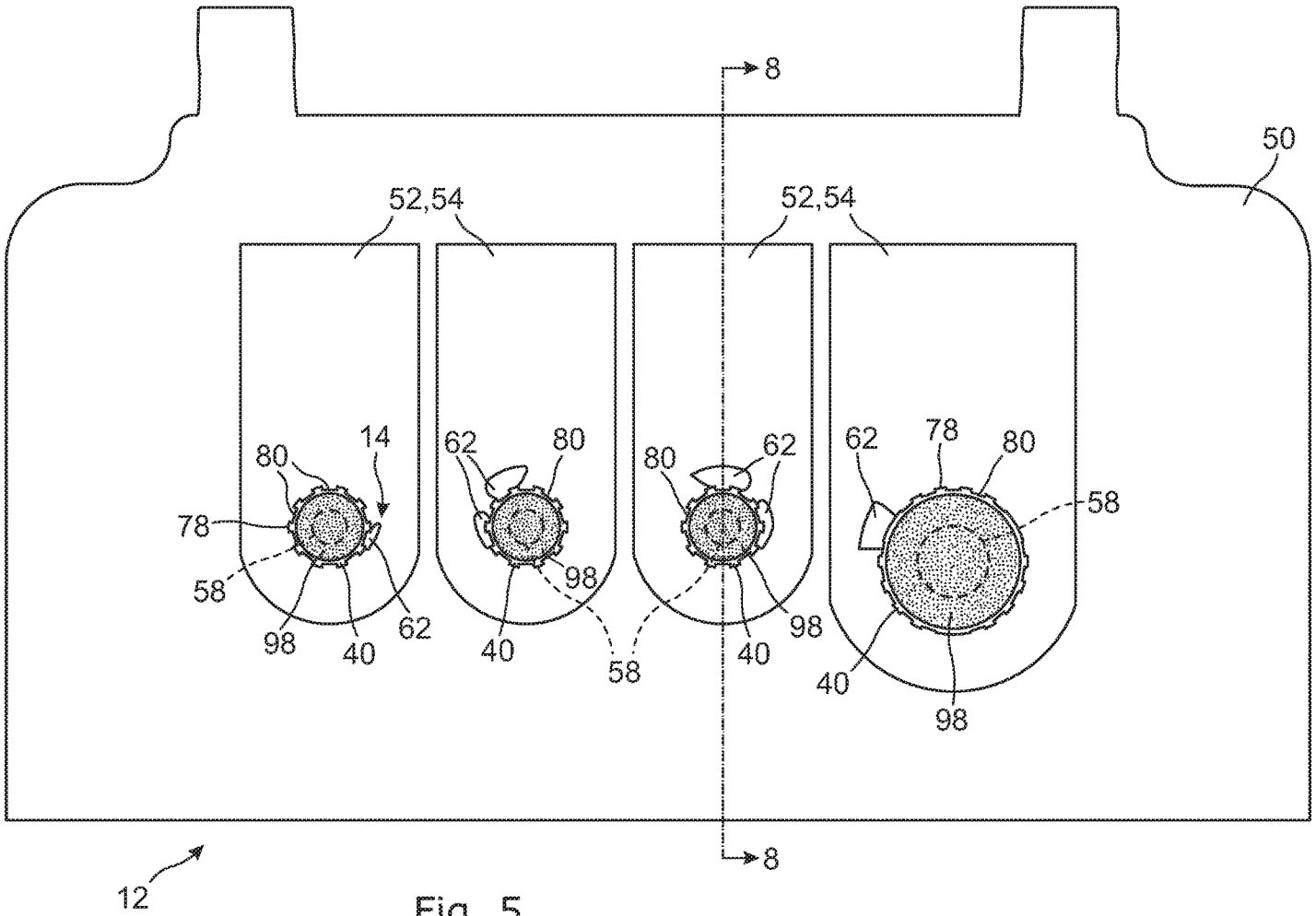
FIG. 5 is a top view illustrating the example structure of FIGS. 2-4 with the tower seals removed to expose air holes.
Figure 6:
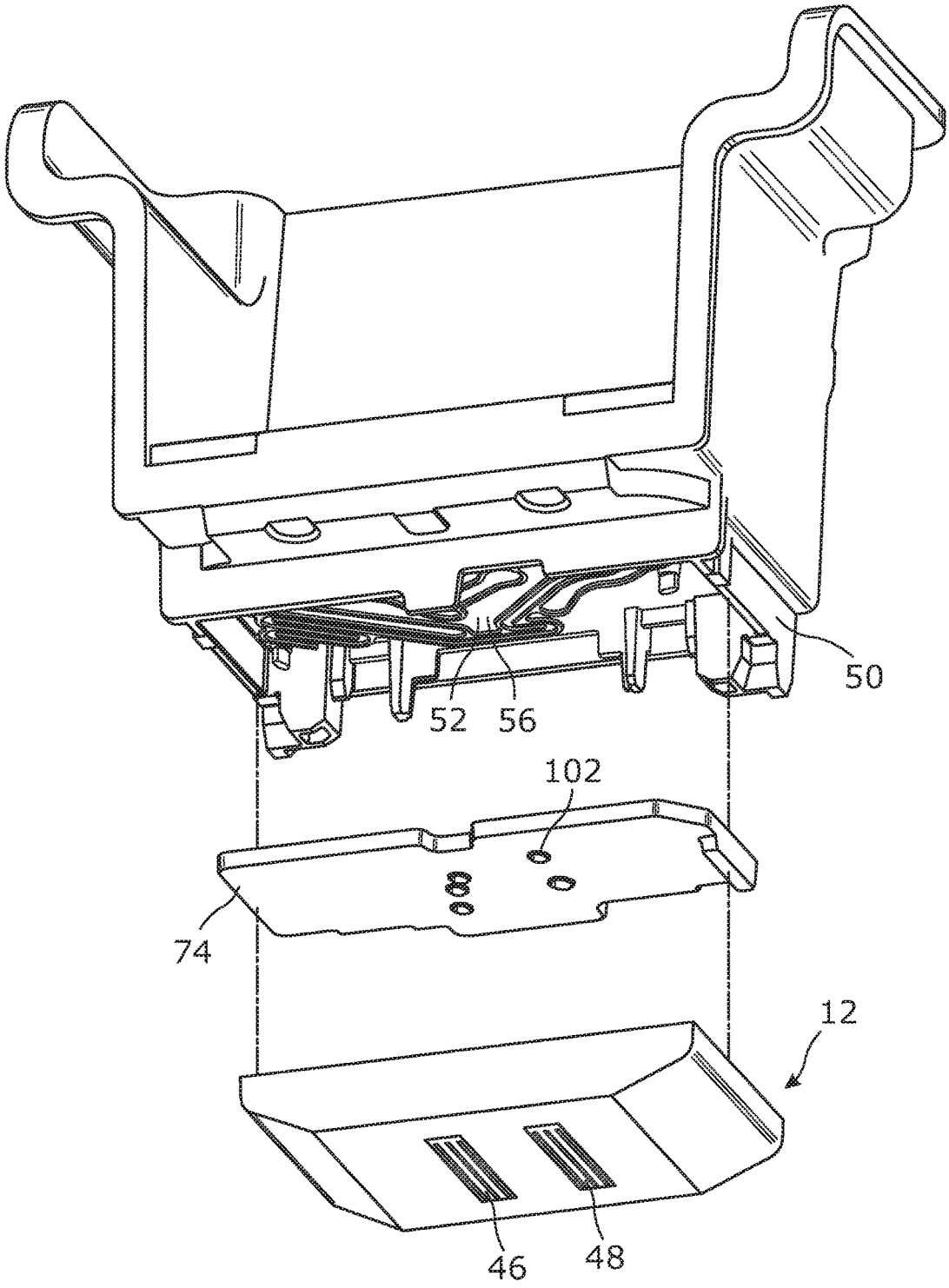
FIG. 6 is an exploded bottom side perspective view of the example structure of FIGS. 2-5.
Figure 7:
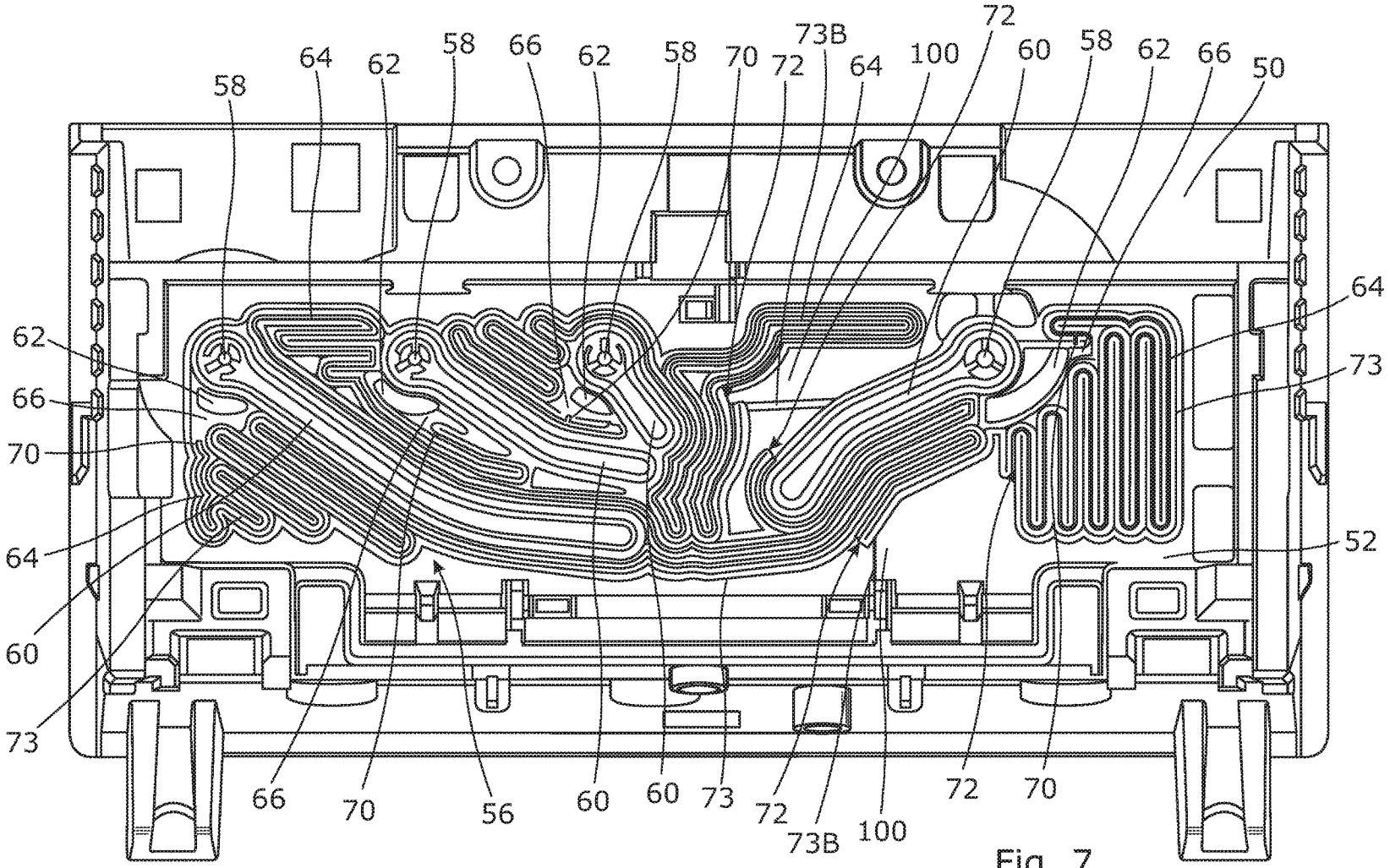
FIG. 7 is a bottom plan view of the example structure of FIGS. 2-6 with the manifold cover and printheads removed to expose the air channels along the underside of the substrate.
Figure 8:
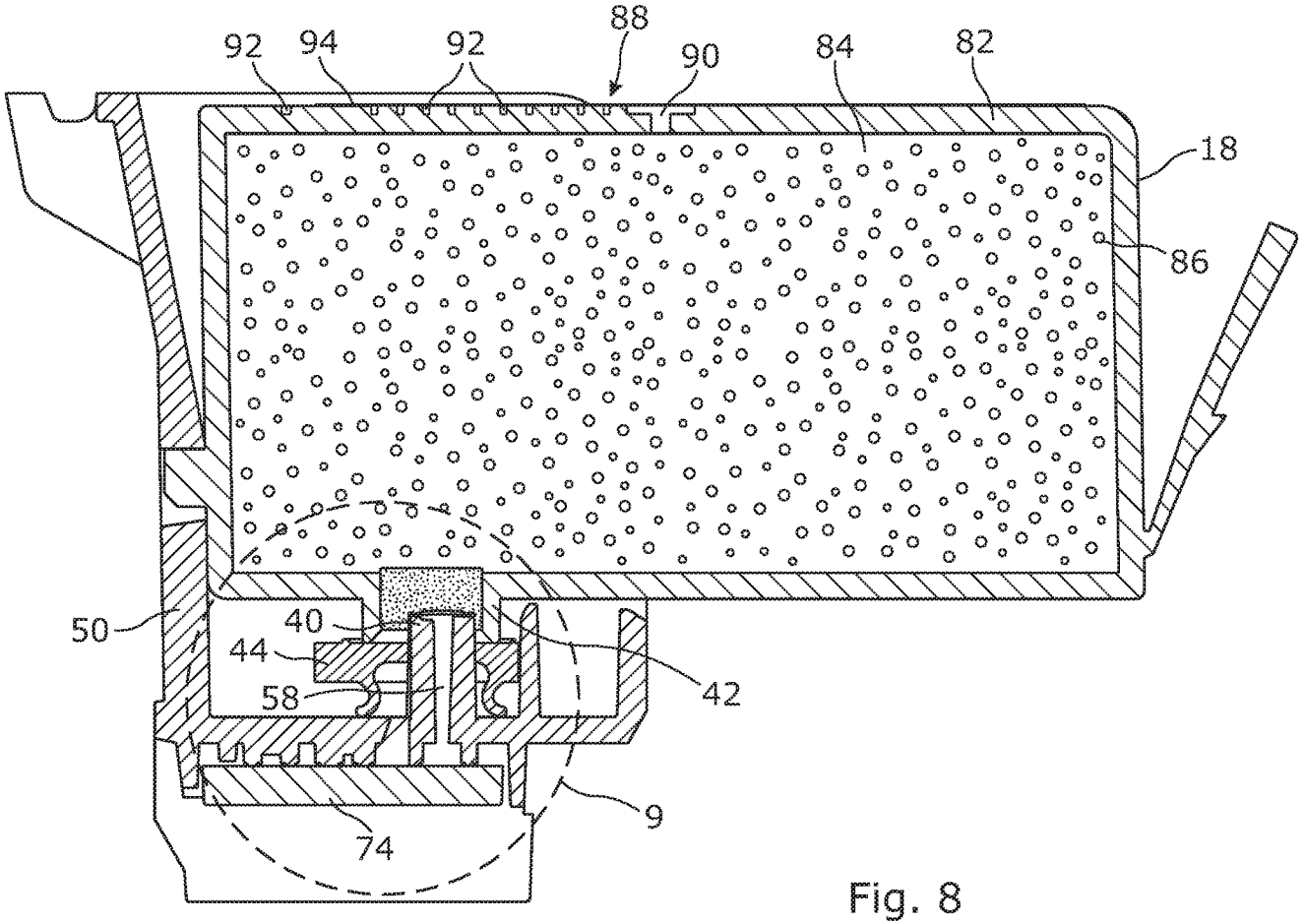
FIG. 8 is a section view of the example structure of FIGS. 2-7 taken along the line 8-8 in FIG. 5 illustrating a vent path from the ink container outlet through the structure.
Figure 9:
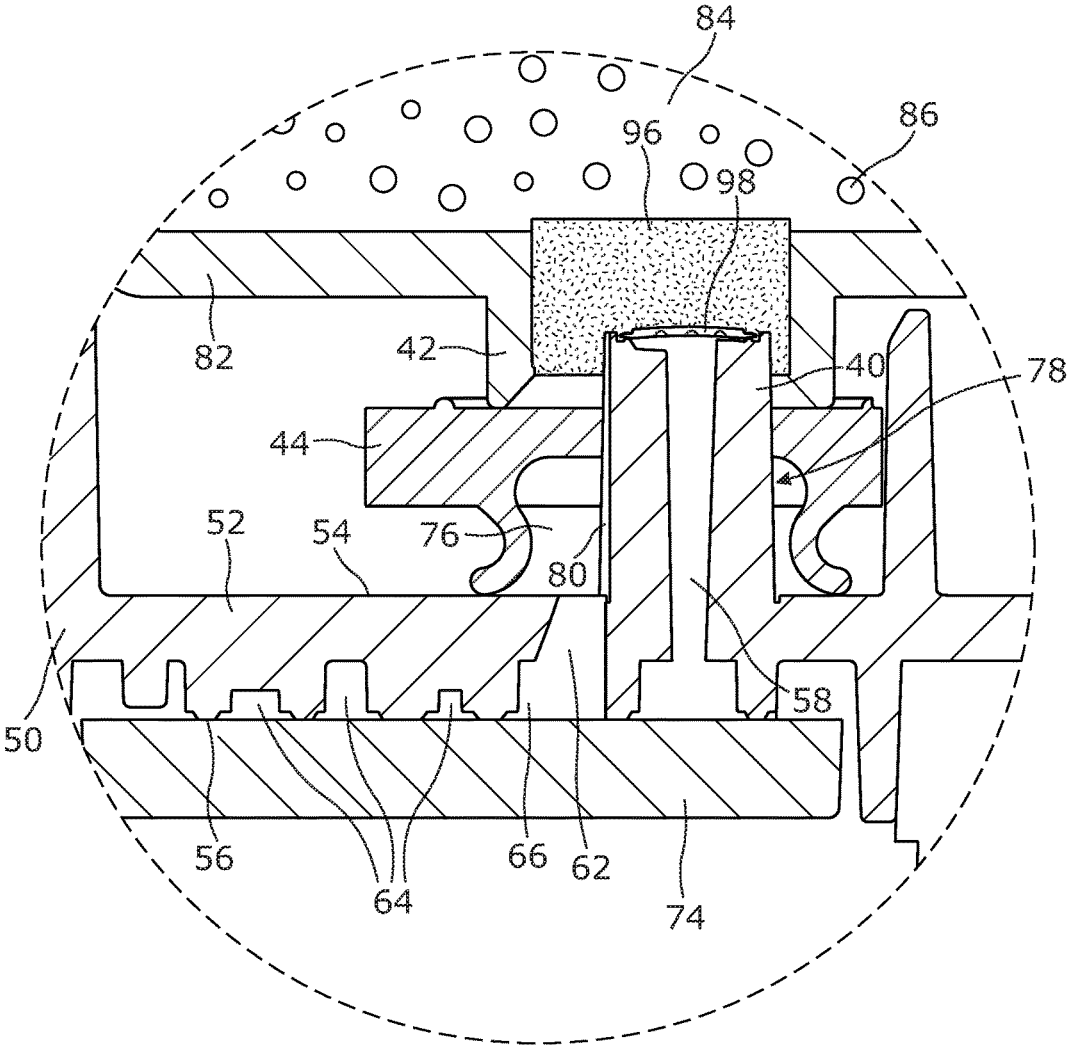
FIG. 9 is a detail view of the structure and container illustrated in FIG. 8.

FIGS. 4 and 5 are an exploded top side perspective view and a top view, respectively, of the structure 50. For illustrative purposes the annular seal 44 is lifted in FIG. 4 and omitted in FIG. 5. FIGS. 6 and 7 are an exploded bottom side perspective view and a bottom view, respectively, of the structure 50. The printheads 46, 48 and the manifold cover are omitted in FIG. 7 for illustrative purposes. FIGS. 8 and 9 are sectional side views of the vent features near the ink inlet 40 with the ink container 18 in a connected state.

Referring to FIGS. 4-9, the support structure 50 supports the printheads 46, 48 and other parts. The ink inlet towers 40 protrude from a generally planar substrate 52 of the support structure 50. While in one example the structure 50 will be installed in the printer so that the substrate 52 is horizontal during printing operations, as shown in the figures, a horizontal substrate 52 is not required. Indeed, substrate 52 alone or integrated into a structure 50 might have different orientations during manufacturing, packaging, storing, shipping, and printing. The ink inlet towers 40 protrude from a first side 54 of the substrate 52. Printheads 46, 48 are mounted to a second side 56 of the substrate 52 opposite to the first side 54. A manifold cover may be disposed between the substrate 52 and the printheads 46, 48. An ink hole 58 in the substrate 52 inside each inlet tower 40 allows ink to flow through each container outlet 42 to a respective printhead 46 or 48 along a corresponding ink channel 60 formed along the second side 56 of the substrate 52. An air hole 62 in the substrate 52 near each inlet tower 40 exposes each container outlet 42 to the atmosphere through a respective unique air channel 64 formed in the second side 56 of the substrate 52, so that none of the inlet towers 40 share one air channel 64. At a distal end 72 of each air channel 64 the air channel 64 communicates with ambient air.

In the example shown in the figures, the individual air channels 64 each include a respective air plenum 66 that connects the air hole 62 with a labyrinth portion of the air channel 64. Each plenum 66 is defined by a separate enclosed space along the second side 56 of the substrate enveloping air holes 62 as best seen in FIG. 7. A first, proximal end 70 of the labyrinth portion of each air channel 64 is open to each of the plenums 66 and the opposite distal end 72 of the air channel 64 is open to the atmosphere. Also, in the example shown in the figures, walls 73 defining the ink channels 60, air channels 64, and plenums 66 are formed in the second side 56 of the substrate 52. In this example, three sides of each enclosed space are formed in the substrate 52 and the fourth side is formed by a cover 74 affixed to the substrate 52. The cover 74 effectively seals the ink and air channels 60, 64 while connecting the ink inlets 40 with the respective printheads 46, 48 through the ink channels 60. The cover 74 is sometimes called a manifold or manifold cover because it helps define the ink distribution manifold formed by the ink channels 60 into the printhead assembly 12.

As illustrated in FIG. 7, each of the air channels 64 is isolated from the other air channels 64 by the walls 73. Isolating the air channels 64 reduces a possibility that under certain circumstances ink would enter one of the air holes 62 and exit another one of the air holes 62 whereby different colors ink could be mixed near one of the ink inlets 40.

In the illustrated examples, the air channels 64 are defined by labyrinths having a length vs. diameter ratio that reduces water or vapor loss while allowing for a desired air flow. In one example the depth of each of the labyrinth air channels 64 is between approximately 0.1 and approximately 1 millimeters, for example between approximately 0.2 and approximately 0.6 millimeters. For example the length of each of the labyrinth air channels 64 is at least approximately 50 millimeters, for example at least approximately 100 millimeters, or for example at least approximately 120 millimeters. In one specific example the length of the labyrinth is approximately 132 millimeter. As illustrated the configuration of the different air and ink channels 64, 60 is such that all ink channels 60 and all individual air channels 64 fit on the second side 56 of the substrate 52. The labyrinths have a serpentine shape. For example each of the labyrinths makes at least five turns that are sharper than 90 degrees, for example 180 degrees turns, providing for an extended air path within a relatively small surface. For example the distal ends 72 of the air channels 64 open into respective enclosed air chambers 100, from where air is vented to and from ambient air. The air chambers 100 at the distal ends are enclosed by the walls 73 of the labyrinths and/or additional migration preventing walls 73B. The additional migration preventing walls 73B can be provided to split the air chambers 100, so that two distal ends 72 or respective air channels 64 do not open into the same air chambers 100.

For example the air holes 62 associated with each inlet 40 may have a size and shape that depends on the available space on the substrate 52. In the illustrated example the air holes 62 have different shapes. For example the air holes 62 are sized as large as possible.

Referring now to FIGS. 8 and 9, each ink inlet tower 40 is surrounded by a seal 44. In connected state, the bottom of each container outlet 42 is pressed into a corresponding seal 44 to make a fluid tight seal that prevents air from escaping between the container outlet 42 and the inlet 40. Seal 44 forms an interior cavity 76 surrounding at least part of the inlet tower 40. The air hole 62 opens into the cavity 76. The outer surface 78 of the inlet tower 40 is recessed at the location of the air hole 62 so that air can move from the cavity 76 past the seal 44 to the container outlet 42. In the example shown, multiple recesses 80 are formed along the outer surface 78 of the inlet tower 40 to achieve the desired air flow between the cavity 76 and the container outlet 42.

For illustrative purposes an example ink container will be described while referring to FIGS. 8 and 9. Each ink container 18-24 includes a housing 82 that forms an interior chamber 84 for holding ink. For convenience, only one ink container 18 is called out in the following description. Ink in the chamber 84 is held in foam or other suitable capillary material 86. In certain examples, a conventional vent 88 on the container 18 vents the ink chamber 84 to the atmosphere. Such vent 88 usually includes an opening 90 in the container housing 82 and a small winding channel 92 covered by an adhesive label 94. The label 94 is shown in phantom lines on container 18 in FIG. 2. A wick 96 in the container outlet 42 forms the fluidic interface between ink container 22 and printhead assembly 12.

When the ink container 18 is installed in the structure 50, the wick 96 engages a corresponding inlet tower 40, for example through a filter 98, to establish the operative fluidic connection between the ink container 18 and printhead assembly 12. When the container 18 is installed in the printhead assembly 12 but not vented correctly through the vent 88, the flow of ink from the container 18 into the printhead assembly 12 during printing and priming would create a high vacuum inside the ink chamber 84, which could lead to starvation of the printheads for ink. The disclosed vents 14 in the structure 50 could allow air to pass around and through the wick 96 into the ink chamber 84 to prevent high vacuums inside the container 18, even if the vent 88 would fail.

Thus, the structure 50 allows for unique paths from the distal ends 72 of the respective air channels 64, through the enclosed chambers 100, along the air channels 64 to respective plenums 66, through the air holes 62 in the substrate 52 to the cavity 76 between the seal 44 and the inlet tower 40, then past the inlet tower 40 along recesses 80 to the wick 96 of a container outlet 42. The air holes 62 in the substrate 52 and the recesses 80 along the inlet tower 40 may be sized and shaped to achieve the desired venting and, where appropriate, to facilitate manufacturing. Printhead support structure 50 usually will be a molded plastic part. In fact, the structure 50 as illustrated in FIG. 7 may be defined by a single cast. Multiple air holes 62 around an inlet tower 40, as shown in FIG. 5, may be used instead of a single larger hole as necessary or desirable, for example to maintain the rigidity of inlet tower 40 to substrate 52.

Figure 10:
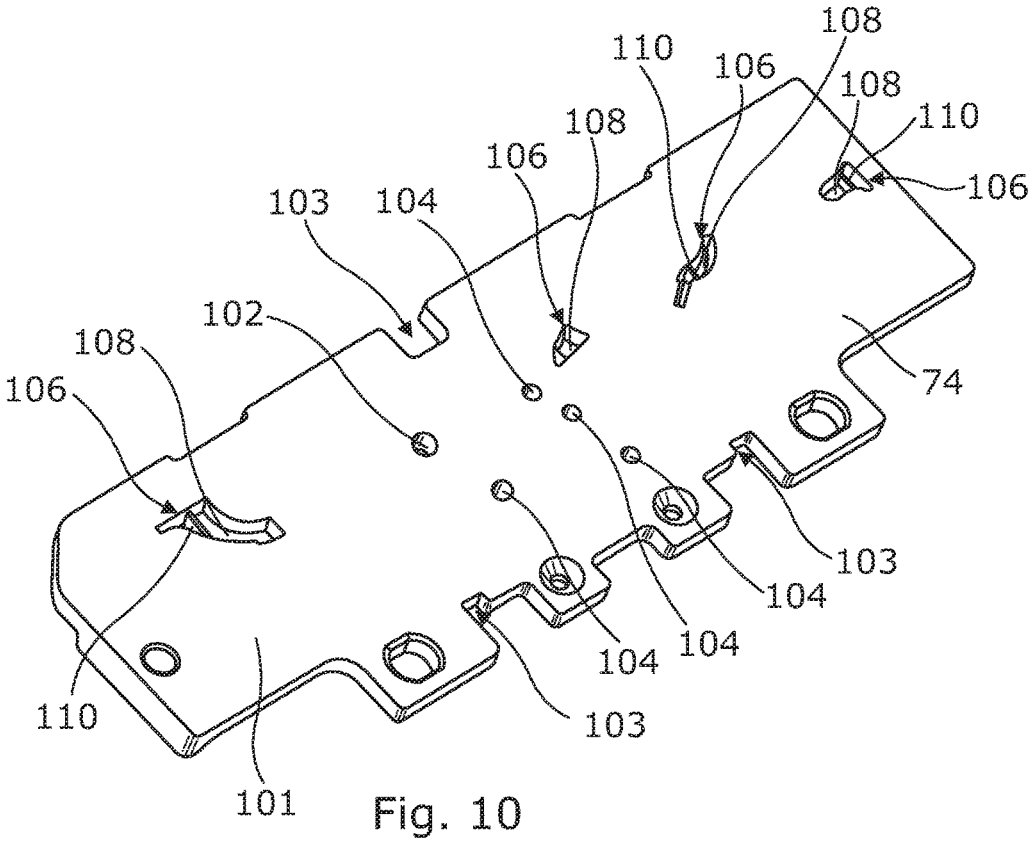
FIG. 10 is a perspective top side view of an example cover for a structure of FIGS. 2-9.

FIG. 10 illustrates a perspective top side view on an example of a cover 74. For example, the cover 74 has a substantially flat top surface 101 to be attached to the second side 56 of the structure 50. In an example the cover 74 includes at least one air vent hole 102, 103 to vent air from and to one of the air channels 64. At least one of the vent holes 102 comprises a through hole. At other locations the air can be vented along a side wall of the cover 74. Here, the vent holes 103 are defined by inward curving, bay shaped edges of the cover 74. The air vent holes 102, 103 allow for air to be vented from or to the respective distal ends 72 of the air channels 64, for example through the enclosed air chambers 100. As illustrated, the cover 74 also includes ink interconnect holes 104 to fluidically connect each of the ink channels 60 with the printheads 46, 48.

Figure 11:
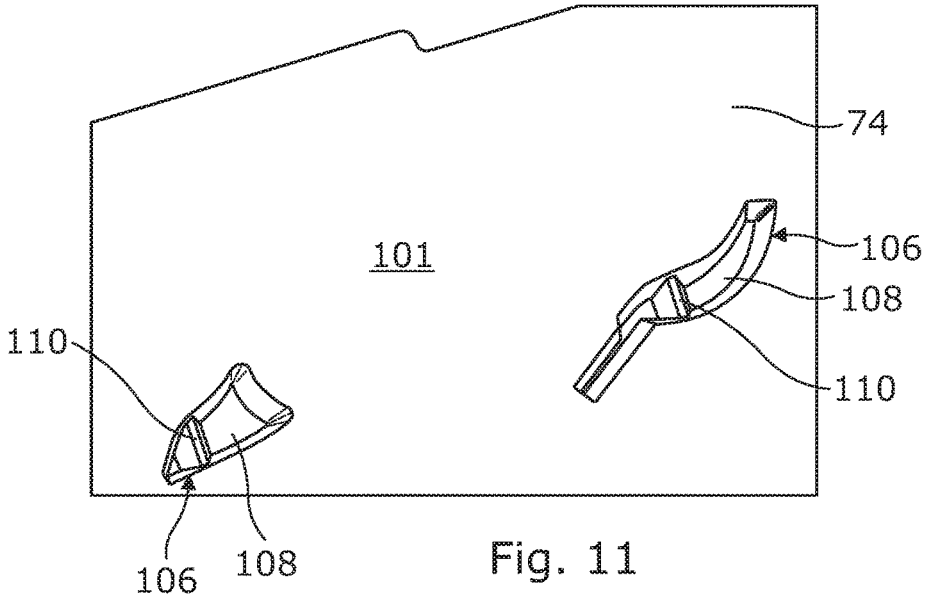
FIG. 11 is a detail view of the example cover of FIG. 10.

As illustrated in FIG. 10, and as illustrated in detail in FIG. 11, the cover 74 includes ink traps 106. In an assembled condition of the cover 74, each ink trap 106 may communicate directly with a first, proximal end 70 of a respective air channel 64 and an air hole 62. The ink traps 106 may be arranged near the air plenums 66. The ink traps 106 include a recess 108 and an ink retain feature 110. The ink retain feature 110 may be defined by a wall spanning a width of the recess 108. In an example the wall does not span a full height of the recess 108. The ink traps 106 will retain ink that accidentally enters the air hole 62. Such ink may flow into the recess 108 whereby the retain feature 110 prevents the ink from flowing into the air channel 64. The recesses 108 may be substantially wider than the diameter of the air channels 64 to allow for enough ink to be trapped during the lifetime of the printer.

Figure 12:
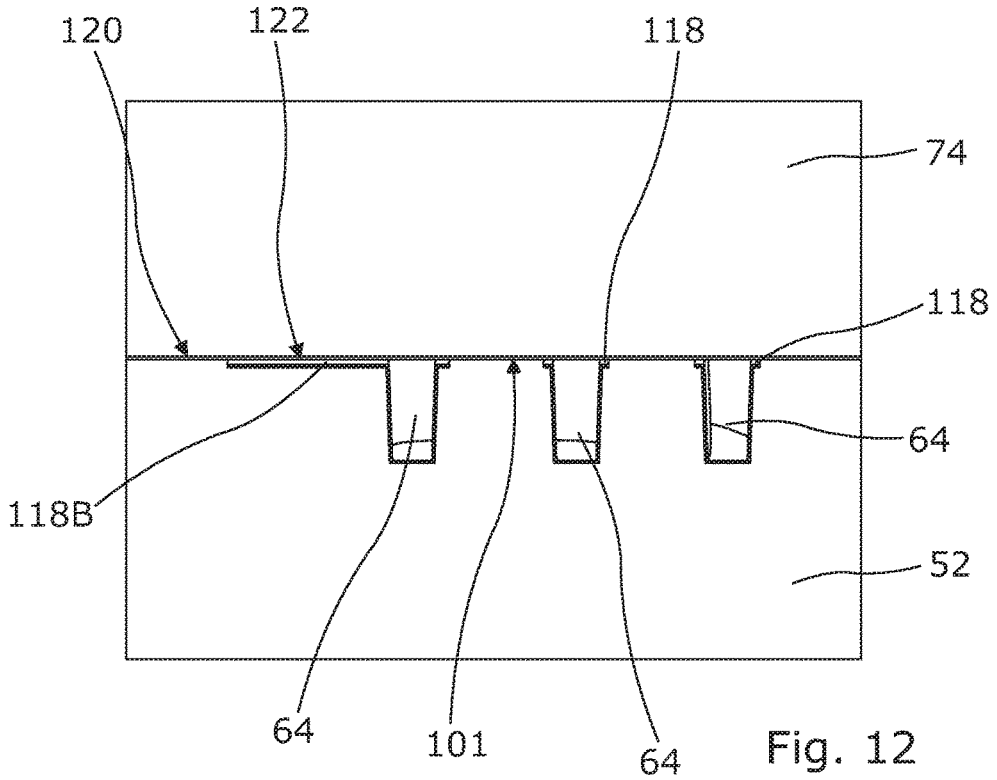
FIG. 12 is a cross sectional view of a detail of an example structure having an air channel with additional narrow slots formed between the substrate and cover.

In a further example that is illustrated in FIG. 12 the air channels 64 include narrow elongate slots 118 that extend along a length of the air channels 64. FIG. 12 illustrates the structure 50 in an upside-down orientation, that is, in a normal operational state. For example the slot 118 extends at the side, or at each side of the air channel 64, and at the base of the air channel 64. For example, the height of the slot 118 is chosen to pull ink by capillary force, to prevent blocking of the air channel 64 by ink. In certain examples the slot has a height of between approximately 10 and 130 micron. The height of the slot 118 may depend on the height of the air channel 64.

In a further example a narrow, large surface slot 118B is provided to allow for more trapping of ink. For example ink that enters an air channel 64 may be pulled into the first mentioned slot 118 and eventually pulled into the large surface slot 118B that allows for even more ink storage, by capillary force. Therefore, the side slots 118, 118B may have a varying width wherein both desired trapped ink storage and available space may play a role.

Figure 13:
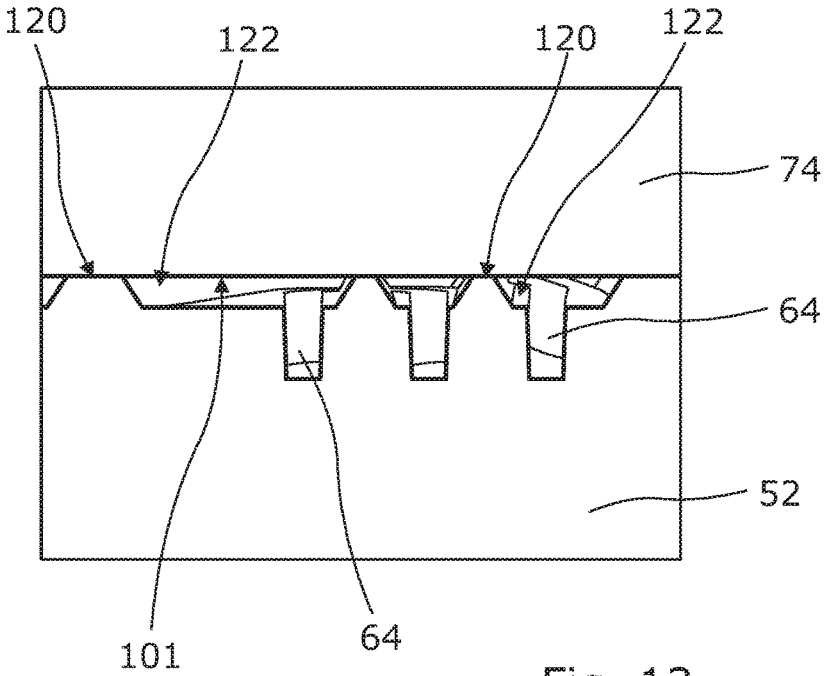
FIG. 13 is a cross sectional view of the example structure detail of FIG. 12, before the substrate and cover are attached.
Figure 14:
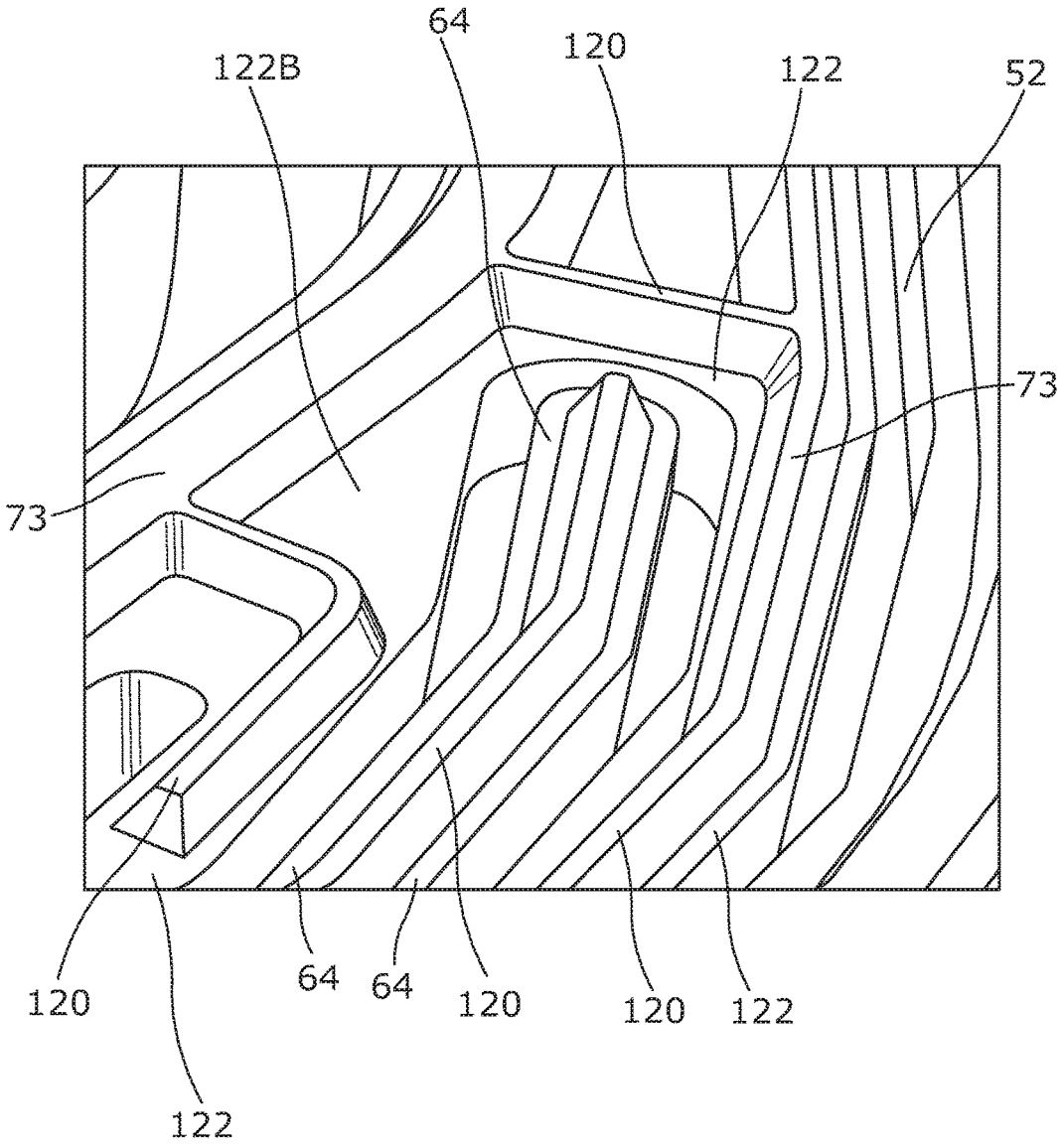
FIG. 14 is a perspective bottom view of the substrate of the example structure of FIGS. 12 and 13.

As best illustrated in FIGS. 13 and 14, again showing the substrate 52 and cover 74 in upside-down orientation, the slots 118 can be formed between the substrate 52 and the cover 74. For example, the air channels 64 formed in the substrate 52 include a first tier 120 defined by a bottom surface of the air channel wall 73, and a second tier 122 that is defined by a step in between. During manufacture, the cover 74 is pressed against the substrate 52 for attaching the two parts. The cover presses into the first tier 120 while deforming the wall 73. Thereby the flat surface 101 of the cover 74 closes in on the second tier 122, without touching the second tier 122, shaping the narrow slot 118. In an example the height difference between the first and the second tier 120, 122 and the pressing force for attaching the cover 74 to the substrate 52 are chosen to obtain a desired final slot height. FIG. 13 illustrates the substrate 52 and cover 74 before said slot formation step and FIG. 12 illustrates the substrate 52 and cover 74 after said slot formation step, that is, in a deformed, final condition. FIG. 14 illustrates the substrate 52 including the air channels with the first tier 120 as defined by a bottom surface of the air channel walls 73 and the second tier 122 in between said bottom surface and air channel base. A large surface second tier portion 122B is illustrated, disposed along the air channel 64 and interrupting normal second tier portions 122, for forming the earlier mentioned ink trapping large surface slot 118B illustrated in FIG. 12.

Some of the mentioned examples allow for venting an ink container even when the ink container vent itself does not work. Some of the mentioned examples allow for said venting while preventing mixing of inks that accidentally enter an air hole or air channel. In some of the examples, if ink from one inlet enters one of the air channels or the air plenum 66 it will not flow to another inlet because the air channels are mutually separate. Furthermore, at least one ink trap can be provided to prevent ink from flowing into or out of the ink channels, and to prevent blocking the air channels. While ink containers generally have a shorter lifetime, some of the described vent and ink trap features can remain in function over the lifetime of the printer, spanning several ink container lifetimes.

As noted at the beginning of this description, the examples shown in the figures and described above illustrate but do not limit the invention. Other examples are possible. Therefore, the foregoing description should not be construed to limit the scope of the invention, which is defined in the following claims.

What is claimed is:

1. A structure for supporting a printhead, comprising:

a substrate having a first side and a second side;

multiple inlet towers on the first side of the substrate, through which respective liquids are to be introduced into the structure, each tower corresponding to a different liquid;

multiple holes through the substrate, each near a respective inlet tower; and multiple separate elongate air channels along the second side of the substrate connected to the respective holes on one end and communicating with ambient air on another end;

wherein each of the inlet towers is associated with a unique one of the air channels; and a first one of the air channels includes a side slot extending along a length of the first air channel, a depth of the side slot being smaller than a depth of the first air channel.

2. The structure of claim 1, further including a cover attached to the second side of the substrate to seal the air channels, the cover including recesses that form liquid traps.

3. The structure of claim 1, wherein the side slot is dimensioned to trap liquid by capillary action.

4. The structure of claim 1, further including a cover attached to the second side of the substrate to enclose the air channels, at least one of the holes passing through the cover to communicate a respective one of the air channels with ambient air.

5. The structure of claim 1, further including:

a seal surrounding one of the inlet towers to seal an outlet of a detachable liquid container against the structure when the container is attached to the structure; and gaps, each of the gaps located between the seal and the inlet tower connected to a respective one of the holes, to allow air to escape along the tower into the outlet of the detachable liquid container when the container is attached to the structure.

6. The structure of claim 5, wherein each of the gaps is formed by at least one recess in an outer surface of the tower at an interface with the seal.

7. The structure of claim 1, wherein the side slot is defined by a gap between the second side of the substrate and a cover pressed against the second side of the substrate.

8. The structure of claim 1, wherein a width of the side slot varies along the length of the first air channel.

9. A structure for supporting a printhead, comprising:

a substrate having a first side and a second side;

multiple inlet towers on the first side of the substrate, through which respective liquids are to be introduced into the structure, each tower corresponding to a different liquid;

multiple holes through the substrate, each near a respective inlet tower; and multiple separate elongate air channels along the second side of the substrate connected to the respective holes on one end and communicating with ambient air on another end, each of the inlet towers associated with a unique one of the air channels, wherein each of the air channels is defined by a unique elongate labyrinth to allow venting while preventing water vapor loss, each of the labyrinths having a length of at least 50 millimeters.

10. The structure of claim 9, wherein each of the labyrinths includes a serpentine channel making at least five turns of at least 90 degrees.

11. The structure of claim 9, further including liquid traps between each of the labyrinths and corresponding ones of the holes.

12. The structure of claim 11, wherein each of the liquid traps includes a recess portion and a retain wall.

13. A structure for a printhead assembly, comprising:

a printhead to dispense liquid;

multiple liquid inlets to receive liquid from a detachable liquid container;

a liquid manifold to distribute liquid from the liquid inlets to the printhead; and multiple unique air channels, each of the air channels associated with only one of the liquid inlets to vent a corresponding liquid container to the atmosphere when the corresponding liquid container is attached to the liquid inlet, each of the air channels including a first portion and a second portion, each of the air channels including a recess on a bottom of the corresponding first portion to trap liquid, a bottom surface of the recess lower than a bottom surface of the corresponding second portion of each of the air channels.

14. The structure of claim 13, wherein the first portion of each of the air channels is located at an end of the corresponding air channel near an inlet.

15. The structure of claim 13, further including unique vent holes at distal ends of corresponding ones of the air channels.

16. The structure of claim 13, further including an elongate narrow slot along a length and at a side of corresponding ones of the air channels to trap liquid by capillary action.

17. The structure of claim 13, further including a retain wall spanning a full width of the recess of each of the air channels, the retain wall not spanning a full height of the corresponding recess.

18. The structure of claim 13, wherein the recess of each of the air channels is substantially wider than a width of the corresponding air channel.

19. A structure for a printhead assembly, comprising:

a printhead to dispense liquid;

multiple liquid inlets to receive liquid from a detachable liquid container;

a liquid manifold to distribute liquid from the liquid inlets to the printhead; and multiple unique air channels, each of the air channels associated with only one of the liquid inlets to vent a corresponding liquid container to the atmosphere when the corresponding liquid container is attached to the liquid inlet, wherein each of the air channels is defined by a unique elongate labyrinth that makes at least five turns of at least 90 degrees, having a length of at least 50 millimeters.

* * * * *